United States Patent [19]

Francis, Jr.

[11] Patent Number: 4,493,591

[45] Date of Patent: Jan. 15, 1985

[54] FLOATABLE OFFSHORE PRODUCTION STRUCTURE AND METHOD FOR FABRICATION, TRANSPORT AND INSTALLATION OF SAME

[75] Inventor: Alex W. Francis, Jr., Tulsa, Okla.

[73] Assignee: Combustion Engineering, Inc., Windsor, Conn.

[21] Appl. No.: 466,803

[22] Filed: Feb. 16, 1983

[51] Int. Cl.[3] ..... B63B 35/44

[52] U.S. Cl. ..... 405/198; 405/203; 405/205

[58] Field of Search ..... 405/196–200, 405/203, 204, 206, 207, 210, 205, 208; 114/264, 265; 175/7

[56] References Cited

U.S. PATENT DOCUMENTS

| | | | |
|---|---|---|---|
| 2,909,900 | 10/1959 | Suderow | 405/196 |
| 2,946,566 | 7/1960 | Samuelson | 405/208 X |
| 3,367,119 | 2/1968 | Rybicki | 405/196 |
| 3,392,534 | 7/1968 | Blenkarn | 405/203 |
| 3,433,024 | 3/1969 | Diamond et al. | 405/205 X |
| 4,007,598 | 2/1977 | Tax | 405/204 X |
| 4,193,714 | 3/1980 | Gjerde | 405/204 |

*Primary Examiner*—Dennis L. Taylor

*Attorney, Agent, or Firm*—Arthur L. Wade

[57] ABSTRACT

A steel-reinforced concrete gravity structure mounts a support framework with which to elevate a production deck above sea level. The structures are separately fabricated on shore, assembled in bordering shallow water, transported as a unit to the subsea well site, and subsequently installed on the sea floor.

4 Claims, 6 Drawing Figures

FLOATABLE OFFSHORE PRODUCTION STRUCTURE AND METHOD FOR FABRICATION, TRANSPORT AND INSTALLATION OF SAME

TECHNICAL FIELD

The present invention relates to the fabrication, assembly, transport, installation and removal of gravity structure, elevating and support framework mounted on top of the gravity structure, and production deck. More particularly, the invention relates to fabrication of the gravity structure and production deck separately in the dry, assembly in shallow water, transport of the assembly as a unit to the subsea well site, and sequentially placing the gravity structure on the sea floor with stability, while jacking the production deck to a predetermined elevation above sea level while maintaining stability.

BACKGROUND ART

For many years, various forms of supports have been used for maintaining production decks above the water in the development of offshore oil fields. The most common support structure in service today is the steel jacket made of tubulars and piled to the sea floor. Recently, gravity structures have been built from steel-reinforced concrete and put in service at offshore oil field locations. These concrete gravity structures usually have a caisson at their lower extremity that serves as a large base and also as a storage capacity for oil production. Both the piled-in-place steel structure and the floated-to-location gravity structure require offshore construction associated with the processing equipment and its allied services. This offshore construction is time-consuming and costly. If this construction can be done onshore, the oil production can be brought onstream with increased economy.

Jackup structures, which find extensive application in drilling operations offshore, have been used for short periods of time as production platforms. These jackup structures for drilling application have some shortcomings when used in production platform services. The fatigue life of the drilling jackup structures is not suitable for the lengthy service requirements for production operations. Likewise, most drilling-type jackup structures have very limited water depth capabilities, especially in areas of harsh environments such as the North Sea. The lack of oil storage in such structures may also be a limiting factor.

The offshore oil industry has identified the need for a production platform-type structure that meets the following criteria:

- A structure that could be floated to the offshore location completely outfitted so that predrilled wells can be brought onstream with minimum delay.
- A structure that can provide oil storage for intermittent tanker loading when needed.
- A structure that has an in-service life of at least 20 years.
- A structure that will accommodate water depths of at least 400 feet in areas such as the North Sea and tolerate the deck loads typical of production operations.
- A structure that has much less catastrophic impact damage susceptibility in contrast to the susceptibility of the drilling-type jackup.

- A structure which includes a tower with which to provide lateral support for the well conductors.
- A structure that can be fabricated with support legs in a substantially horizontal position, the legs subsequently being elevated to their permanent vertical position by the use of the jacking mechanism to the subsequently utilized between the production deck and the support legs.

DISCLOSURE OF THE INVENTION

The present invention contemplates a combination which includes a gravity structure which has a caisson for the storage of well products and which provides an upper horizontal surface. This combination includes support structure permanently mounted on the upper horizontal surface and extending a minimum of four support legs vertically upward from the surface. Finally, the combination also includes a buoyant production deck including all the equipment for receiving, processing, and discharging oil well fluids, the deck being nestable within the support legs and on the upper horizontal surface of the gravity structure. Jackup structure connecting the legs and the deck provide for elevation of the deck to a predetermined elevation above the sea surface, after the gravity structure is placed at its predetermined location relative to the predrilled subsea oil wells.

The present invention more specifically contemplates the gravity structure provided with a regular geometric shape in plan and flotation chambers extending from the surface at locations which will maintain the gravity structure surface in a stable horizontal plane while the gravity structure is floated.

More specifically, the gravity structure is provided an esentially square shape in plan with a cylindrical buoyancy chamber projecting above the surface at each corner.

The invention further contemplates two rows of support legs on the upper surface of the gravity structure, each row containing at least two legs and the production deck nested between the two rows while on the surface of the gravity structure during flotation.

The invention further contemplates a method of construction which includes separate fabrication of the gravity structure and production deck in the dry, with subsequent assembly in neighboring shallow water for flotation transport to the subsea well site.

The invention further contemplates the method of completing installation of the structural combination at the well site by decreasing buoyancy of the gravity structure and utilizing the buoyancy of the production deck while jacking the gravity structure downward to the well site.

The invention further contemplates fabricating the support legs to the upper surface of the gravity structure by fabricating the legs in a horizontal extension, hinging the lower end of the leg to the gravity structure, and finally elevating the leg to its permanent vertical position on top of the gravity structure through the use of the jacking mechanism subsequently employed to elevate the production deck along the vertical leg.

Other objects, advantages and features of this invention will become apparent to one skilled in the art upon consideration of the written specification, appended claims, and attached drawings.

BRIEF DESIGNATION OF THE DRAWINGS

Figure 2A:
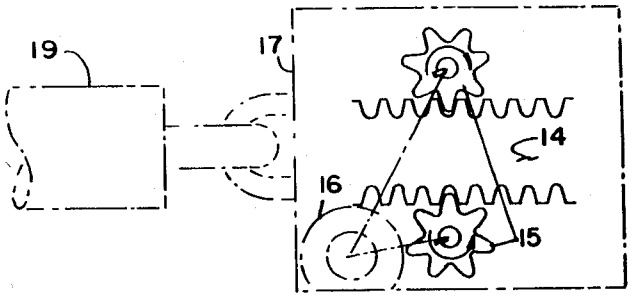
FIG. 2 is an isometric of the gravity structure of FIG. 1 under construction with one of its legs being fabricated in a horizontal position preparatory to being hinged to a vertical orientation on top of the gravity structure.
Figure 2:
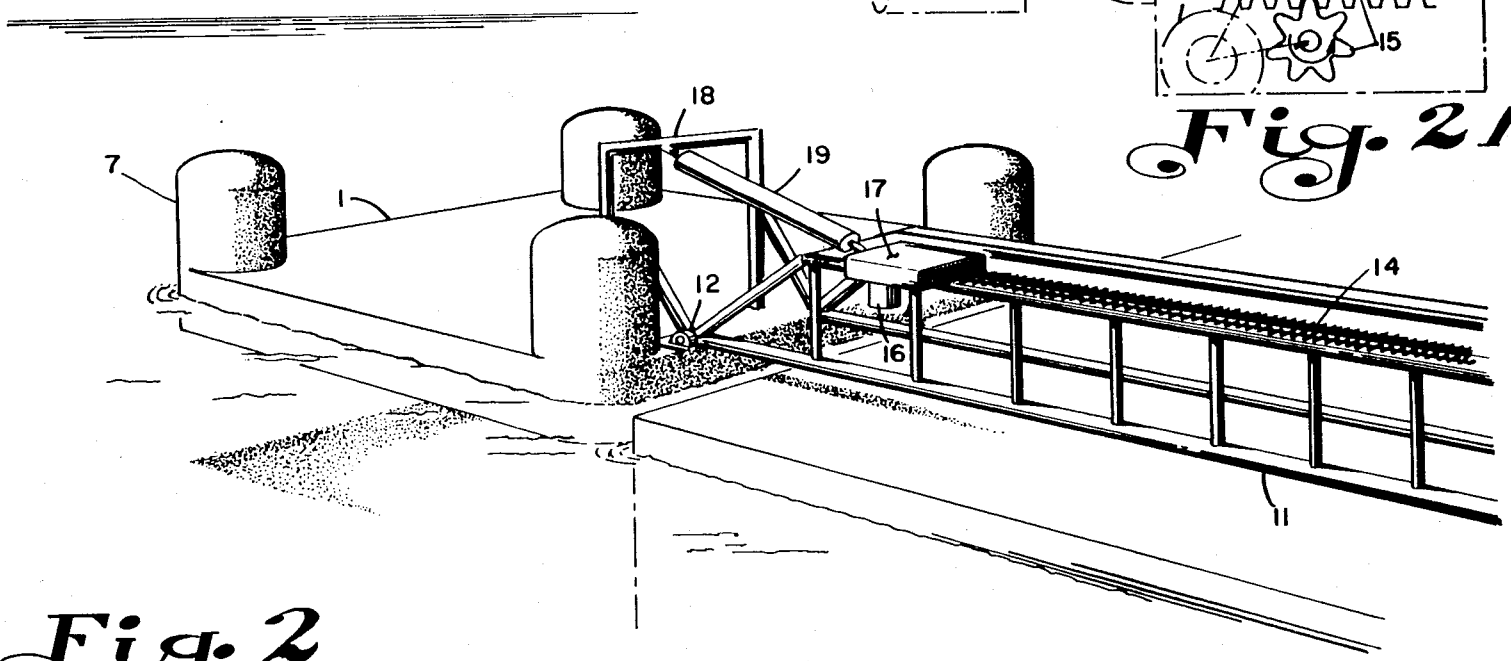
Figure 3:
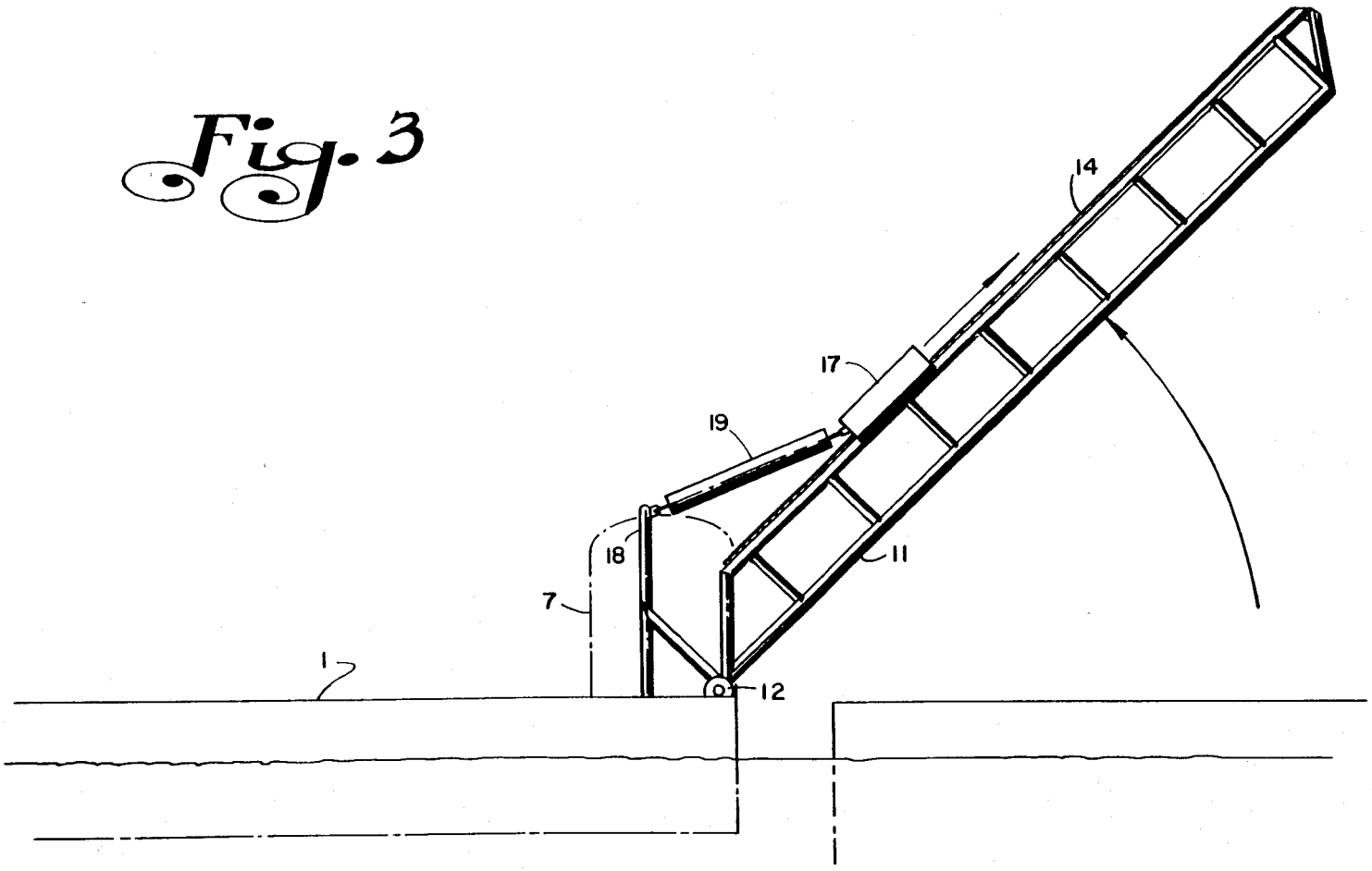
Figure 4:
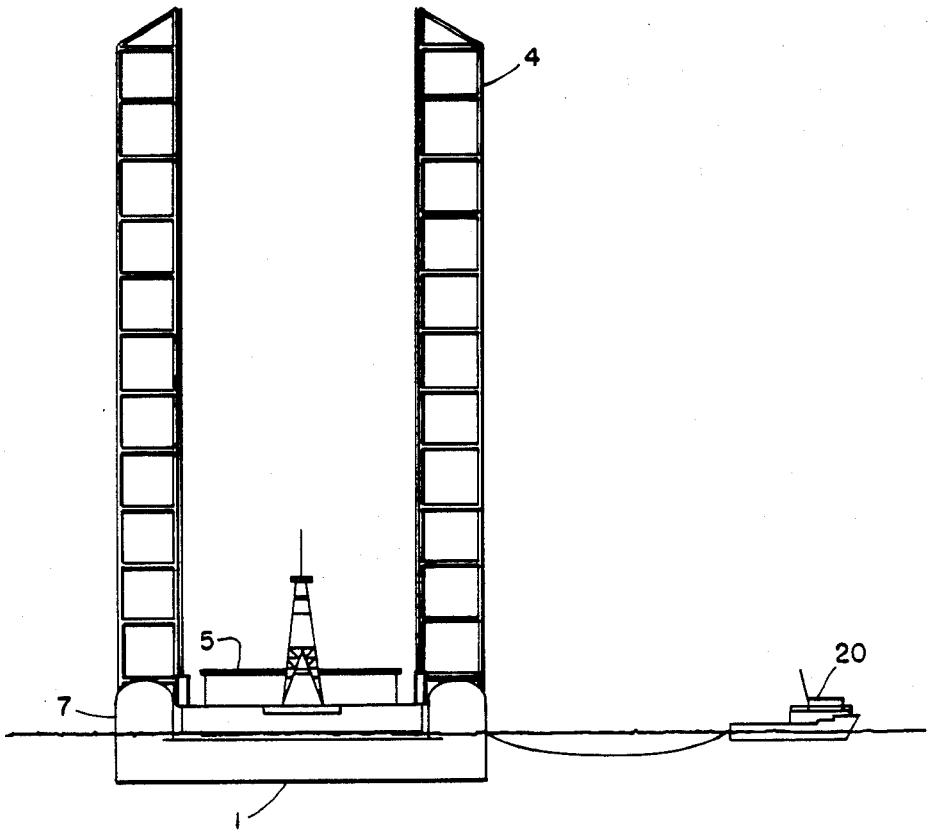
Figure 5:
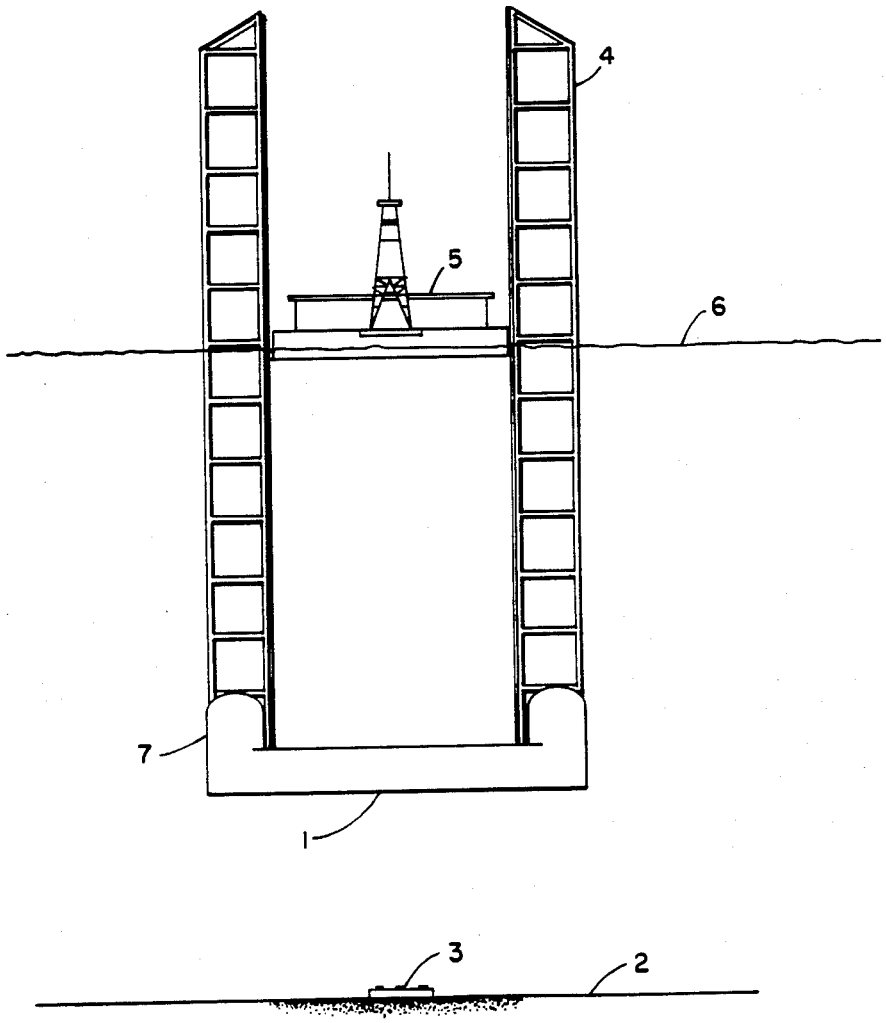

FIG. 2*a* is a cutaway in plan of the jacking structure of FIG. 2;

FIG. 3 is the structure of FIG. 2 with the fabricated leg in transition between the horizontal position and its vertical installation;

FIG. 4 is an elevation of the gravity structure and production deck as being towed between the construction site and the production site; and FIG. 5 is an elevation of the gravity structure and production deck at the well site with the gravity structure being sunk to the subsea well site, utilizing a method of the invention.

BEST MODE FOR CARRYING OUT THE INVENTION

Terms and Technology

This disclosure adds to the technology with which offshore production platforms will be able to withstand winter gales of hurricane force possibly generating waves in the order of 80 feet high. Presently, attention is focused on these severe conditions which are in the North Sea. The financial stakes are high in this area of oil production. The drilling and production platforms require millions of dollars in investment. However, the recovery of these investments is possible in the rich discoveries in the North Sea, whether made in the past, present, or future.

Gravity structures bear the weight of high hopes as the basic building block of production platforms. Heavily reinforced with steel, these concrete structures are sized to be positioned on the ocean floor adjacent to oil wells, and provide both a stable foundation for structure, and also, caissons for storage of products from the oil wells. In plan view, the gravity structure may be given one of several geometric forms. Probably, the more simple form of substantially a square will be more often selected. In all events, the present disclosure contemplates the gravity structure having an upper horizontal surface on which a support framework will be permanently mounted.

Support framework mounted permanently on the gravity structure will include a series of vertically extending legs, preferably metallic and tubular in form. It is contemplated that the area of the surface will enable bracing and cross-bracing to be provided by a tubular framework, and even guy lines of suitable metallic cable. However braced, tubular support legs will be arranged in two parallel columns across the center of the gravity structure surface to accommodate a production deck nested between the two columns.

The production deck will contain all the paraphernalia required to withdraw products from the oil well, separate oil, water and gas, and provide field processing of these products. A prominent feature of this collection of equipment is its mounting in a unit which has a significant degree of buoyancy which is essential to the stability of the gravity structure as the gravity structure is lowered to its final position on the ocean floor. It is from this production deck that the personnel directs all the operations associated with handling the products of the oil well as these products are withdrawn from below the floor of the ocean, processed, stored, and delivered to transporting devices for delivery on shore.

Buoyancy chambers are provided at the periphery of the horizontal surface of the gravity structure. If, as more likely, the plan of the surface is square, a buoyancy chamber would be provided at each corner of the surface and extend vertically a significant distance to add a substantial component of stability to the gravity structure during its flotation intervals. These chambers may be hugh, metallic vessels, but are preferably reinforced concrete, suitably anchored by one end to positions selected for them on the upper horizontal surface of the gravity structure.

A well pipe conductor tower is supported by the framework on the top of the gravity structure. This tower is, essentially, a large conduit permanently mounted on the framework to extend from the sea floor on which the gravity structure rests, up to the final, elevated position of the production deck above the surface of the sea. This conductor tower is primarily designed to laterally support the smaller conduits which must extend from the wellheads on the sea floor, up to the production deck equipment.

Method of Fabrication, Assembly, Flotation and Setting at the Well Site

A significant component of the present invention is the method with which the installation is brought together at the well site. The method begins with the fabrication phase at onshore locations adjacent the body of water over the subsea well. The concept includes the separate fabrication of the gravity structure and its support framework, while the production deck is also fabricated at an adjacent shore location. Fabrication in the dry will enable this construction to be carried out as economically as possible.

It is contemplated that both structures will be separately launched and subsequently assembled in a depth in the order of 150 feet. The production deck will be nested between the two columns of support legs of the framework, and the resulting combination will be buoyant and stable. The towing of this combination can then proceed from the assembly depth to the well site.

The third phase comprises the sequential steps of the method by which the gravity structure is placed on the bottom at the well site, and the production deck is elevated to its final position on the support framework. The method contemplates controlling the buoyancy of the gravity structure as it begins its descent to the ocean floor. The buoyancy chambers may be adjusted and the flooding of the caisson compartments of the gravity structure may be used to initiate the necessary negative buoyancy of the gravity structure. The buoyancy of the production deck will be brought into effect by jacking the deck upward on the support legs which will apply a downward force on the gravity structure. The buoyancy of the production deck as it traverses the support legs will maintain stability of the combination as the gravity structure continues its descent to its final seabed position. Once the gravity structure is grounded, the production deck can continue to be jacked upward on the support legs and reach its final position above sea level and with access to the upper end of the conductor tower. Subsequently, the steps of this method may be reversed to remove the gravity structure from the seabed, bring it together with the production deck, and float the combination to a repair and maintenance facility.

FIG. 1

The first figure of the drawings is designed to disclose all the embodying structure of the invention in place at the wellheads. The gravity structure 1 is grounded on the seabed 2 adjacent the wellheads 3. Support structure 4 is generally indicated in support of production deck 5 well above the water level 6. Thus, the three basic components of the combination, gravity structure, support framework, and production deck, are in their final respective positions to receive the products of the oil wells and process and store these fluids.

These structural elements in which invention is embodied are placed in their final, relative positions with a procedure that embodies novel methods. In carrying out the novel method, use will be made of buoyancy chambers 7 in order to add a substantial component of stability to the gravity structure 1 during its flotation and sinking into the FIG. 1 position. Specifically, each buoyancy chamber 7 will be attached to the gravity structure 1 at a predetermined location on the surface. For example, with the square shape for the gravity structure upper surface, a buoyancy chamber will be attached at each corner. Properly sized and containing sufficient air, the buoyancy chambers provide upward force of sufficient magnitude to each corner of the gravity structure and maintain the flat upper surface of the gravity structure substantially horizontal while it is being positioned in the sea.

Finally, conductor tower 8 extends from the wellheads 3 up to the production deck 5 to provide lateral support for each of the lines connecting the wellheads to their respective processing equipment on the deck. Thus, FIG. 1 discloses the "end result" of fabricating the gravity structure 1 and production deck 5, along with their connecting framework, under the concepts of the methods of the invention.

First Fabrication Phase

Figure 1:
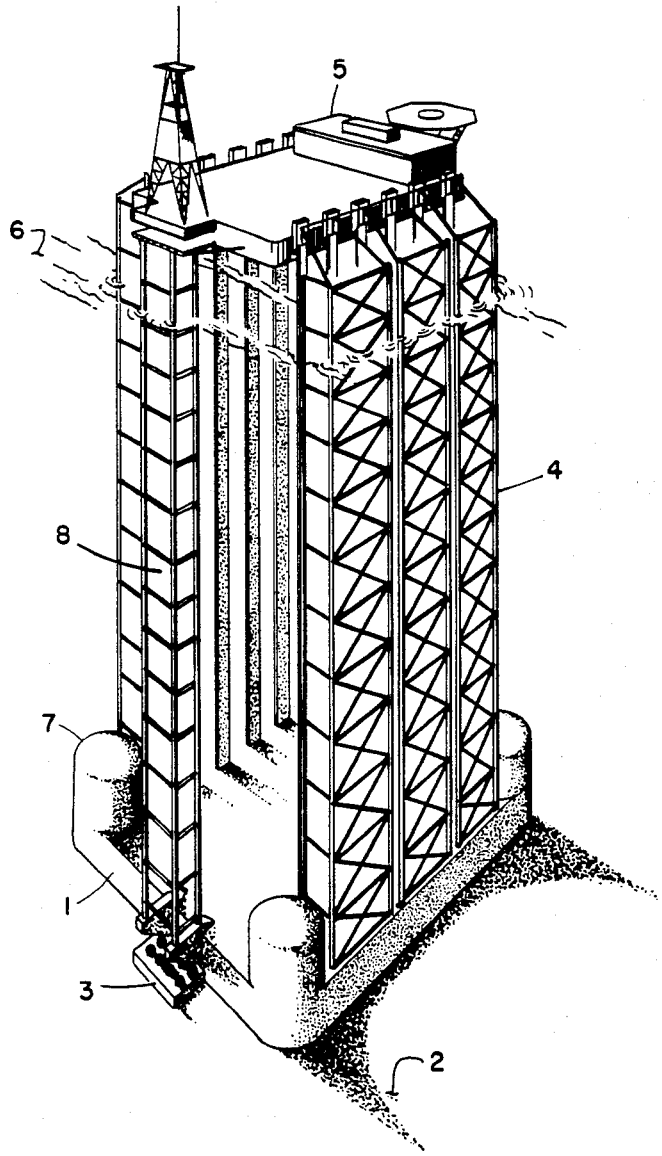
FIG. 1 is an isometric of a concrete gravity structure, vertically mounted on the structure is a production deck on the upper end of the legs, all constructed in accordance with the inventive method and structurally embodying the invention.

In flash-back from the final phase of FIG. 1, FIG. 2 discloses the structural arrangement with which the invention is embodied and that method employed in its fabrication. The gravity structure 1 is depicted as floating in shallow water and readily accessible to fabrication facilities on shore. A leg 11 of support structure 4 is represented as under fabrication while in a horizontal position. This leg 11 represents all the legs of support structure 4. No more than the one leg is disclosed in order to simplify the disclosure. The thrust of the message projected by FIG. 2 is that fabrication of these leg members is greatly facilitated by the horizontal position. The advantages of this arrangement need no further elaboration.

Leg 11 is hinged at 12 to the base structure on the upper surface of gravity structure 1. After the fabrication of leg 11 in its horizontal position, the jacking mechanism, which will be subsequently employed to elevate the production deck 5, is put to a dual usage in elevating the leg 11 until the leg stands vertically on its base to which it is hinged at 12.

The jacking mechanism is essentially comprised of a rack 14 extending the length of leg 11, gears 15 engaging the teeth of rack 14, and motor 16 rotating the gears 15 in order to cause traverse of the rack by the gears and motor. The gear/motor combination 17 is connected to a pivot 18 by a tension/compression link 19. Tethered to pivot 18 by one end, the tension/compression link 19 will enable the motor/gear 17 to swing the leg 11 toward its permanent vertical position on its hinged base. Thus, the jacking mechanism is utilized for the dual purpose of elevating the production deck 5 and completing the fabrication of leg 11 by elevating the leg into its final position where it will be incorporated into the framework 4.

FIG. *2a* is submitted as a disclosure of the details of the motor/gear combination 17 as connected to rack 14. In this FIG. *2a*, gears 15 are shown in their engagement with the teeth of rack 14. The gears 15 are rotated by a mechanical connection indicated with motor 16. Again, the combination of motor and gears is connected to an end of tension/compression link 19.

The invention contemplates that leg 11 represents how the leg structure may be elevated by the jacking mechanism. The concept includes the elevation of more than one leg at a time. Suitable cross-members between a plurality of legs can be provided and linked to the tension/compression link 19. The only significant complication is the operation of the motor/gear combination 17 of each leg during the elevation operation. Further, it is apparent that link 19 will be under tension in the initial lifting of the leg, or legs, and go into compression loading if the leg or legs pivot past the intended vertical position about base hinge 12.

FIG. 3 is offered in this flash-back sequence to dramatize the fabrication step of elevating leg 11 toward its final, vertical position atop the upper surface of gravity structure 1. FIG. 3 discloses how the rigid tension/compression link 19 is the key element in that while pivoted by one end at 18, it is placed under tension by its other end being moved up rack 14 when motor 16 operates gears 15. It is through the tension of this link 19 that leg 11 is lifted from its horizontal position of FIG. 2 toward its vertical position of FIG. 1, as, more or less, the final fabrication step of incorporating the leg into the framework 4. Once in the vertical position, the leg 11 may be hinged somewhat past its center of gravity through hinge 12 and throw the link 19 into compression. Thus, the selection of the terminology tension/compression for this link 19. Functionally, link 19 is a simple crane member for picking up leg 11, putting it into its vertical orientation and holding it in such vertical orientation until permanently stabilized by whatever guys and stays are necessary to form the complete framework 4. Once so utilized, link 19 can be disconnected from leg 11 and moved to like service between selected pivot points, comparable to 12, and the other legs fabricated in their horizontal positions and finally incorporated into framework 4. The emphasis is on the fact that the jacking structures 14, 15, 16, are employed to fabricate the legs into the framework 4 and subsequently utilized in unnesting production deck 5 to its location at some predetermined elevation on these self-same legs.

The Assembly and Flotation Phase

FIG. 4 depicts the technological Ark in route between the fabrication and assembly site of FIGS. 2 and 3 to the subsea location of FIG. 1. To put this package together, the relatively shallow water adjacent the fabrication slip of FIGS. 2 and 3 is utilized to sink the gravity structure 1 far enough to permit buoyant production deck 5 to be moved between the two columns of support legs. When nested between the two leg columns, deck 5 is grounded upon the upper surface of the gravity structure 1 as a flotatable unit which can be towed to the FIG. 1 site.

FIG. 4 dramatizes the unitary assembly of gravity structure 1 and production deck 5 being towed by a suitable tug 20. Of course, more than one tug may be desirable, or even necessary. This is a nautical problem of no immediate concern to the disclosure of the invention. The teaching is that in the art of providing these gravity structures and their support of production decks at subsea locations, the present invention brings together a gravity structure and production deck in a single towable package which can be brought over the well site ready to be set in place with a minimum of shifting relative positions of the gravity structure and deck. Not only is the fabrication and assembly facilitated by the invention as disclosed thus far, but the towability and emplacement of the structures is carried out with novelty. FIG. 4 emphasizes these features.

The Final Method Phase—Emplacement

FIG. 5 discloses the method of emplacing the structures towed to the FIG. 1 site. FIG. 4 discloses how the package arrives over the FIG. 1 site and now FIG. 5 discloses the implementation of the method with which gravity structure 1 is lowered to the FIG. 1 position and the function of production deck 5 as it is given a role in this implementation.

In FIG. 5, gravity structure 1 is disclosed as having been given a negative buoyancy by suitable flooding. The gravity structure is sinking toward its predetermined location on the seabed. Not only is gravity structure 1 urged downward by its own negative buoyancy, but the jacking mechanism which connects production deck 5 to the support structure 4 is actuated to exert downward force on the legs of the support structure. During this transition, both the buoyancy chambers 7 on the gravity structure 1, and the buoyancy of production deck 5, combine to provide a significant stabilizing force on the gravity structure to militate against its sidewise movement or tendency to tip in any direction from the horizontal.

Once gravity structure 1 is eased to its final seabed resting place, it becomes a firm foundation with the support structure 4 brought into its final function. That final function of the support structure 4 is the provision of the means with which production deck 5 is jacked upward a suitable distance above the sea level. It is fully expected that the support structure can be fabricated to extend the hundreds of feet upward from gravity structure 1 necessary to support production deck 5 above the reach of the hundred-year storm wave crest. In this event, the invention provides the method with which the flotatable package of gravity structure 1 and production deck 5 can be separated and erected on the seabed at the well site. It is expected that subsequent exhaustion of the wells, or necessity for inspection or repair of the structure will demand removal of the unit. Upon such demand; the procedure within the inventive method can readily be reversed. The production deck can be jacked down to the surface of a suitably calm sea far enough to regain buoyancy. Positive buoyancy of the gravity structure 1 can be regained by proper injection of air into its caisson cavities and the gravity structure 1 eased upward as disclosed in FIG. 5. Eventually, the configuration of FIG. 4 can be attained and the package towed to the new location.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. An offshore production installation for a subsea location, including,
   - a steel-reinforced concrete gravity structure which includes a caisson section for oil storage and has a regular geometric shape in plan and provides a horizontal upper support surface,
   - a framework permanently mounted on the upper horizontal surface of the gravity structure and vertically extending at least four support legs a predetermined distance above the gravity structure and providing access to a position within the framework and on top of the gravity structure,
   - a plurality of buoyancy chambers connected to the upper horizontal surface of the gravity structure at spaced locations where they will function to provide stability during flotation of the gravity structure,
   - a buoyant production deck nestable in the position provided within the support legs of the framework and on the upper horizontal surface of the gravity structure,
   - and jacking mechanism connecting the production deck to the support legs with which the production deck is moved between the upper horizontal surface of the gravity structure and a predetermined elevation above the gravity structure.

2. The installation of claim 1, wherein, the gravity structure is substantially square in plan and one of the buoyancy chambers is mounted at each of its corners.

3. The installation of claim 1, including, a well pipe conductor tower mounted on the framework to extend from the bottom of the gravity structure to the predetermined elevation of the production deck above the gravity structure.

4. The method of fabricating an offshore production platform comprising a steel-reinforced concrete gravity structure having a horizontal upper support surface, a framework extending up from the support surface including vertical legs with a rack extending up the length of each leg, and a production deck connectable to the support legs by a jacking mechanism engaging each leg rack, including,
   - fabricating the gravity structure in the relatively shallow water adjacent to land,
   - fabricating each leg of the framework in its horizontal position and hinging one end of the leg to the support surface of the gravity structure,
   - extending a tension/compression link between a pivot point on the support surface and a jacking structure engaged with the rack of the fabricated leg, elevating the fabricated leg by actuating the jacking mechanism to advance the jacking mechanism along the leg rack whereby the tension/compression link is caused to hinge the fabricated leg from its horizontal fabrication position to its vertical orientation from the hinge to enable the leg to be incorporated into the framework mounted on the support surface, and utilizing the jacking mechanism for controlling the vertical elevation of the production deck.

* * * * *